US010059411B1

(12) United States Patent
Ebrahimi

(10) Patent No.: US 10,059,411 B1
(45) Date of Patent: Aug. 28, 2018

(54) QUAD BOW PADDLE BOARD

(71) Applicant: Shaine Shahin Ebrahimi, Carbondale, CO (US)

(72) Inventor: Shaine Shahin Ebrahimi, Carbondale, CO (US)

( * ) Notice: Subject to any disclaimer, the term of this patent is extended or adjusted under 35 U.S.C. 154(b) by 0 days.

(21) Appl. No.: 15/483,973

(22) Filed: Apr. 10, 2017

Related U.S. Application Data

(60) Provisional application No. 62/320,494, filed on Apr. 9, 2016.

(51) Int. Cl.

| | |
|---|---|
| ***B63B 35/00*** | (2006.01) |
| ***B63B 1/00*** | (2006.01) |
| ***B63B 35/73*** | (2006.01) |
| ***B63B 35/81*** | (2006.01) |
| ***B63B 35/79*** | (2006.01) |
| ***B63B 3/08*** | (2006.01) |
| ***B63B 7/08*** | (2006.01) |
| *B63B 35/26* | (2006.01) |

(52) U.S. Cl.
CPC ..... *B63B 35/7913* (2013.01); *B63B 3/08* (2013.01); *B63B 7/085* (2013.01); *B63B 35/7926* (2013.01); *B63B 35/26* (2013.01)

(58) Field of Classification Search
CPC ..... B63B 7/08; B63B 35/792; B63B 35/7913; B63B 7/085; B63B 35/7926; B63B 3/08; B63B 35/26
USPC ..... 441/66, 74, 79; 114/263, 266
See application file for complete search history.

(56) References Cited

U.S. PATENT DOCUMENTS

| | | | | |
|---|---|---|---|---|
| 3,156,483 | A * | 11/1964 | See | A47C 27/081 280/18 |
| 4,100,870 | A * | 7/1978 | Prade | B63B 7/04 114/352 |
| 4,844,595 | A * | 7/1989 | Nealy | G02B 23/22 114/66 |
| 5,297,899 | A * | 3/1994 | Culley | E02B 3/064 405/219 |
| 5,820,430 | A * | 10/1998 | Hornsby | B63B 35/7906 441/65 |
| 7,051,668 | B1 * | 5/2006 | Quinto | B63B 21/00 114/263 |

* cited by examiner

*Primary Examiner* — Anthony D Wiest
(74) *Attorney, Agent, or Firm* — Plager Schack LLP

(57) ABSTRACT

A hull assembly is configured to accommodate propulsion in at least two directions at once. The hull assembly includes a dual bow board further comprising a first bow and a second bow with an insert box therebetween. The insert box travels through the dual bow board from a top side to a bottom side.

3 Claims, 11 Drawing Sheets

QUAD BOW PADDLE BOARD

RELATED APPLICATION

This application claims priority to provisional patent application U.S. Ser. No. 62/320,494 filed on Apr. 9, 2016, the entire contents of which is herein incorporated by reference.

BACKGROUND

The embodiments herein relate generally to naval architecture, that is the design of vessels. More particularly, these embodiments focus on personal watercraft.

Prior to embodiments of the disclosed invention, there was no efficient vessel to accommodate an activity where two or more participants were trying to paddle in opposite directions on a standup paddleboard (or SUP). Embodiments of the disclosed invention solve this problem.

SUMMARY

A hull assembly is configured to accommodate propulsion in at least two directions at once. The hull assembly includes a dual bow board further comprising a first bow and a second bow with an insert box therebetween. The insert box travels through the dual bow board from a top side to a bottom side.

BRIEF DESCRIPTION OF THE FIGURES

The detailed description of some embodiments of an embodiment of the invention is made below with reference to the accompanying figures, wherein like numerals represent corresponding parts of the figures.

DETAILED DESCRIPTION OF CERTAIN EMBODIMENTS

Figure 1:
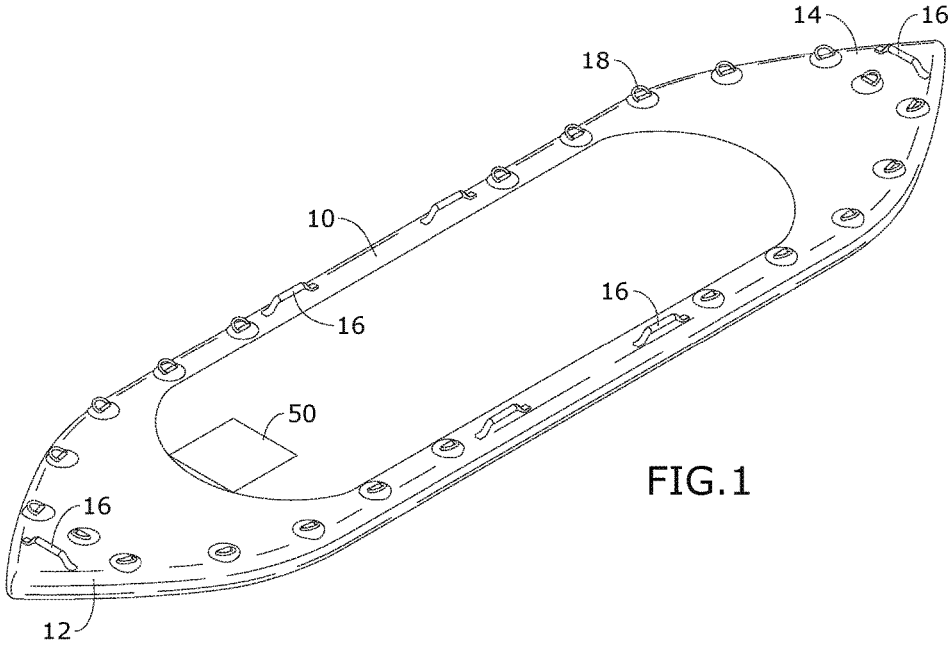
FIG. 1 shows a top perspective view of an embodiment of the invention shown with the insert 50.
Figure 2:
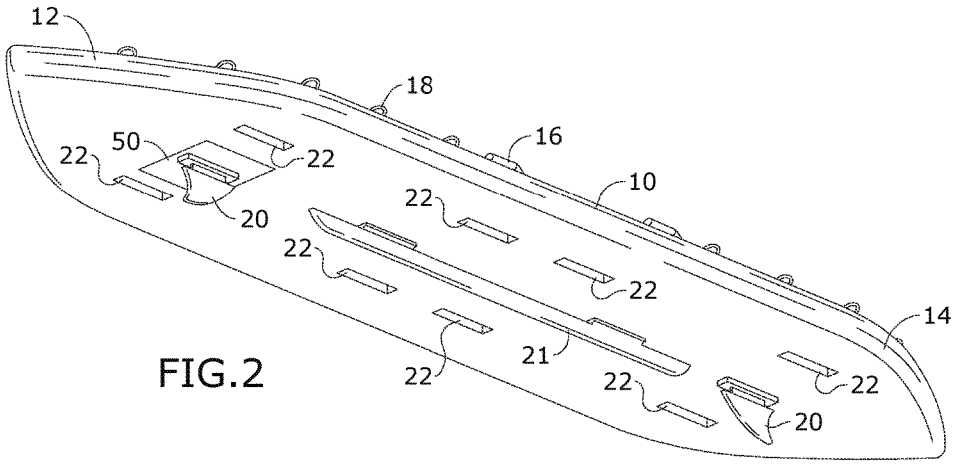
FIG. 2 shows a bottom perspective view of an embodiment of the invention, shown with opposing fins 20 in an exemplary arrangement, the insert 50, and removable keel 21.
Figure 3:
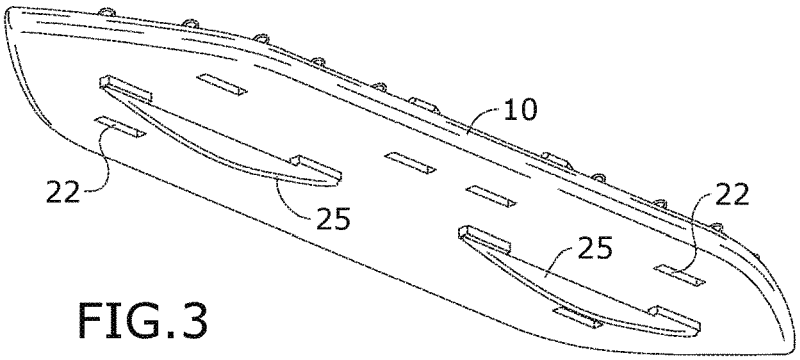
FIG. 3 shows a bottom perspective view of an embodiment of the invention, shown with removable keels 25.
Figure 4:
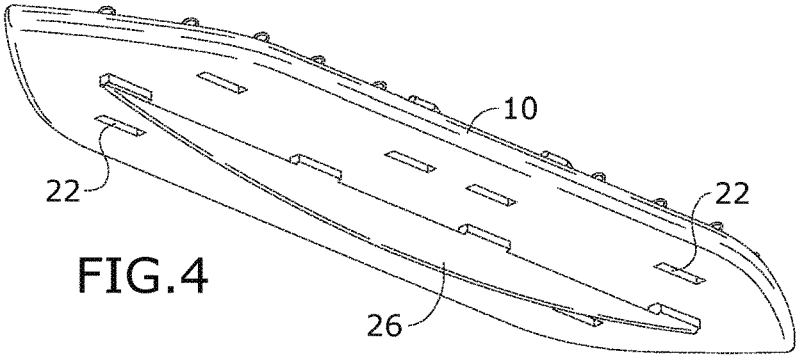
FIG. 4 shows a bottom perspective view of an embodiment of the invention, shown with removable full length keel 26 in an exemplary arrangement.
Figure 5:
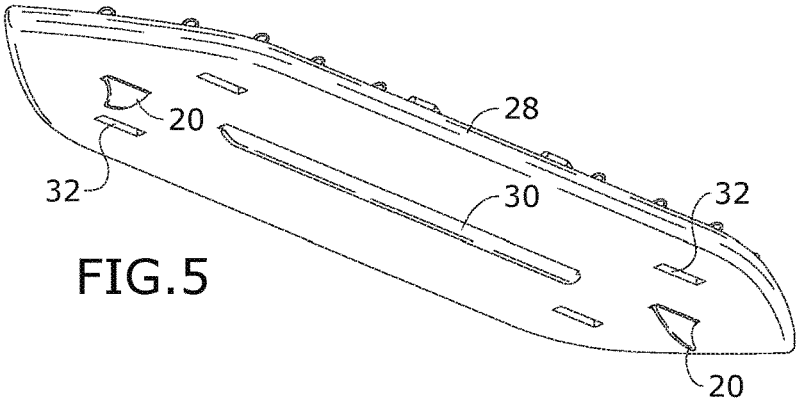
FIG. 5 shows a bottom perspective view of an embodiment of the invention, shown with opposing fins 20 and removable keel 30 in an exemplary arrangement.
Figure 6:
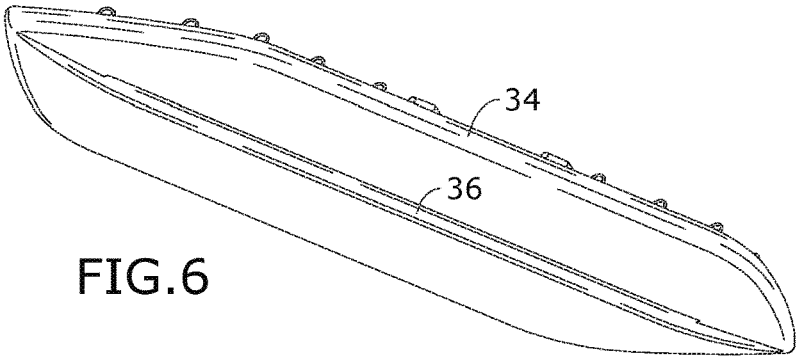
FIG. 6 shows a bottom perspective view of an embodiment of the invention, shown with removable keel 36 in an exemplary arrangement.
Figure 7:
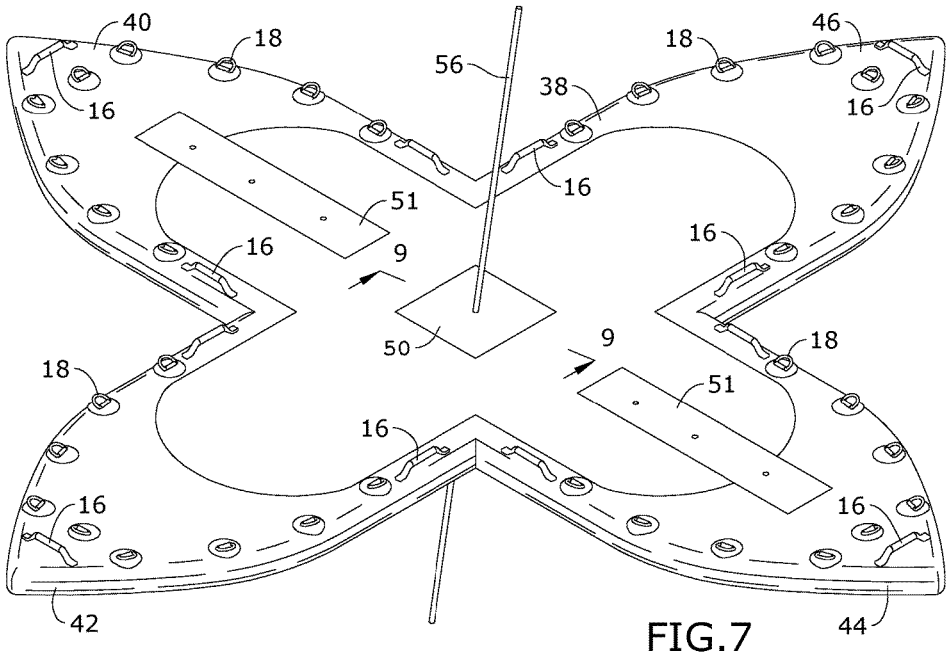
FIG. 7 shows a top perspective view of an embodiment of the invention shown with the insert in two sizes, and a stabilization rod.
Figure 8:
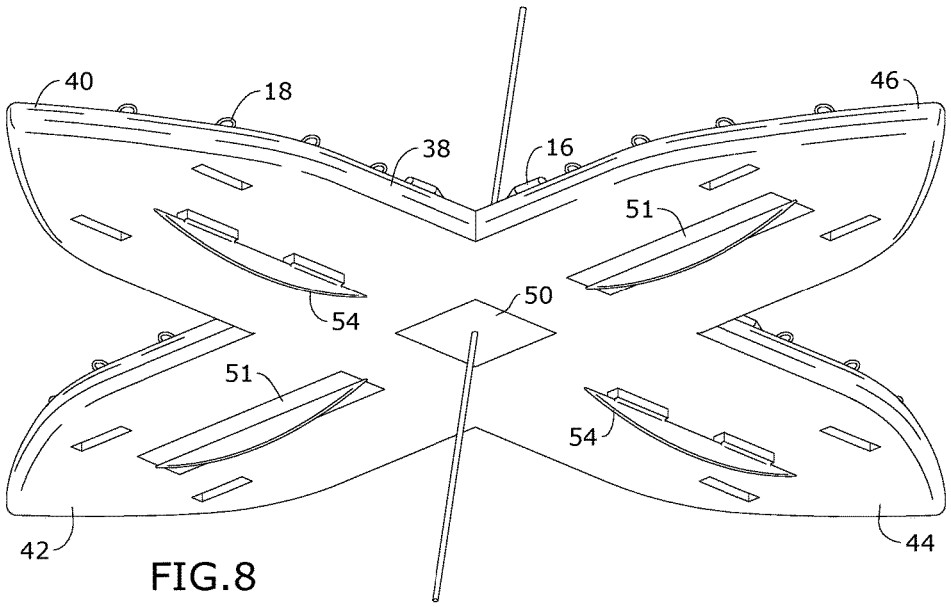
FIG. 8 shows a bottom perspective view of an embodiment of the invention shown with the insert in two sizes, stabilization rod, and removable keels.

By way of example, and referring to FIGS. 1-6, one embodiment of the present system comprises a dual bow board 10 further comprising a first bow 12 and a second bow 14. A plurality of handles 16 and a plurality of lash rings 18 are attached to a top side of the dual bow board 10. An insert box 50 travels through the dual bow board 10 from the top side to the bottom side. The bottom side further comprises a plurality of accessory slots 22 in which a fin 20, a mid-keel 21, a short box mount keel 25, or a long box mount keel 26 can be placed. A hull bottom 28 shows an arrangement with distal accessory slots 32 and short keel 30. A hull bottom 34 shows no distal accessory slots 32 but rather uses a long keel 36. Long keel 36 can either be fixed or detachable.

Turning to FIGS. 7-14, quad bow board 38 further comprises a first bow 40 a second bow 42, a third bow 44 and a fourth bow 46 with insert box 50 amidships therebetween. The first bow 40 and the third bow 44 are further attached to a long insert 51 traveling from a top side to a bottom side. The bottom side is further attached to a pair of long inserts 51 and a pair of block or fin box mounted keels 54.

Figure 9:
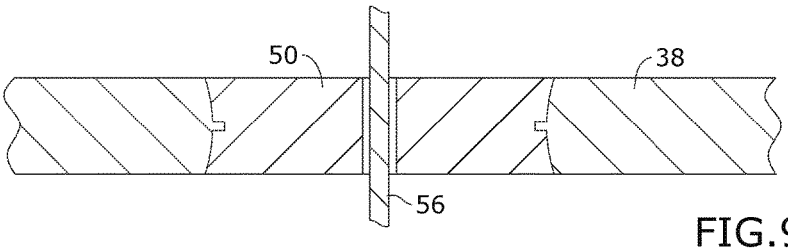
FIG. 9 shows a section view of an embodiment of the invention shown with a stabilization rod going through insert 50, taken along line 9-9 in FIG. 7.
Figure 10:
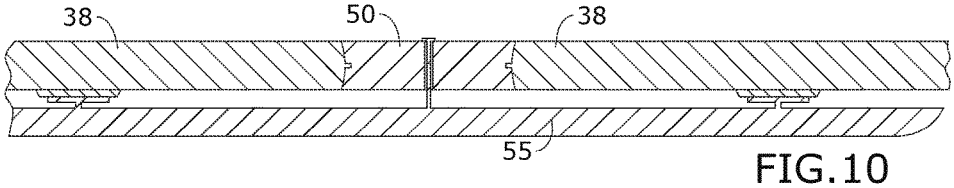
FIG. 10 shows a section view of an embodiment of the invention, with a removable keel 55 attached to the fin box.

FIG. 9 shows this construction in more detail. The insert box 50 is rigid with a female insert. The quad bow board 38 is inflatable with a male insert that mates with the female insert to hold the insert box 50 in place. Once that is done a stabilizing pole 56 can be inserted through a channel in the insert box 50. Alternately, as shown in FIG. 10, a long keel 55 can be placed over the channel.

Figure 11:
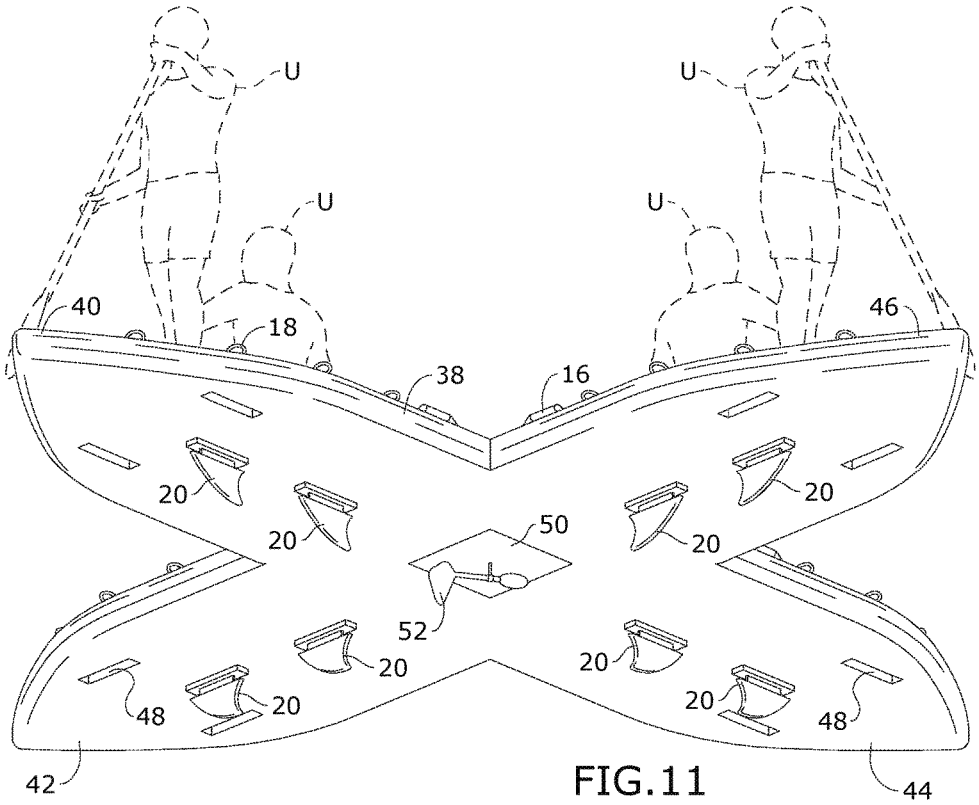
FIG. 11 shows a bottom perspective view of an embodiment of the invention, shown with fin vane 52, removable opposing fins 20, opposing users U, and insert 50.
Figure 12:
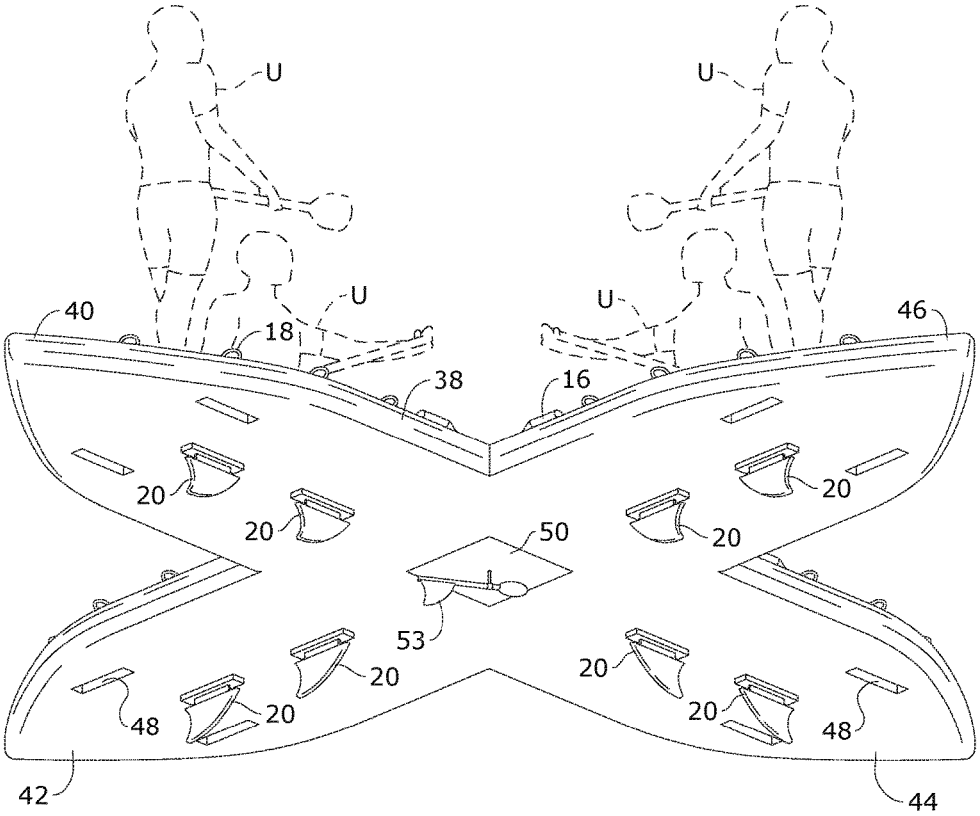
FIG. 12 shows a bottom perspective view of an embodiment of the invention, shown with fin vane 53, removable opposing fins 20, opposing users U, and insert 50
Figure 13:
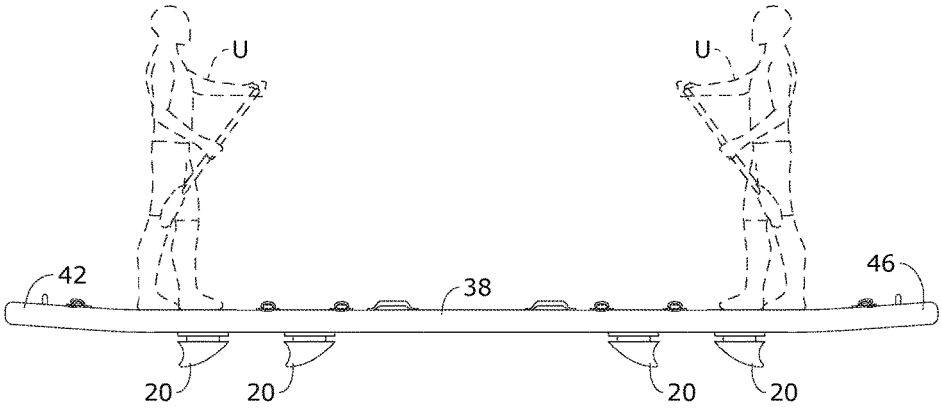
FIG. 13 shows a side view of an embodiment of the invention, shown with fin vane 52, removable opposing fins 20, opposing users U, and insert 50.
Figure 14:
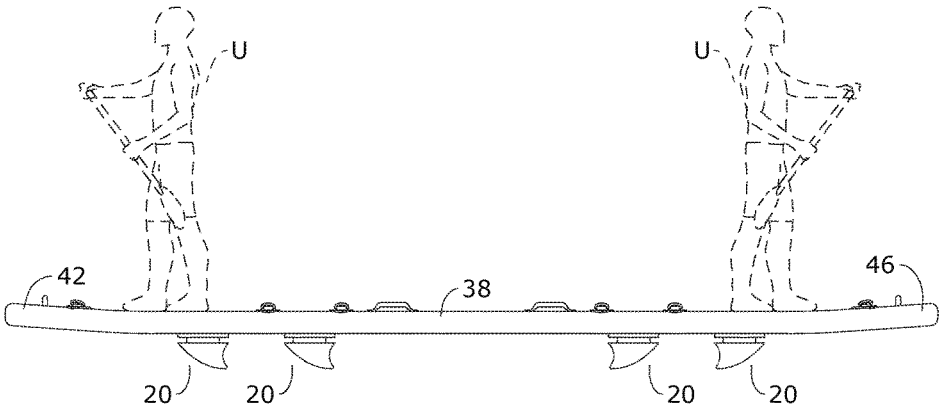
FIG. 14 shows a side view of an embodiment of the invention, shown with fin vane 53, removable opposing fins 20, opposing users U, and insert 50.

FIG. 11 shows a vane 52 in the insert box 50 and the quad hull accessory slots 48 with the fins 20 pointing outward. In FIG. 12, the fins 20 are pointed inward. FIGS. 13 and 14 show the reason for the difference. The competition involves having users U try to determine who can paddle the best. The fins 20 can be aligned with the direction of the users U.

Figure 15:
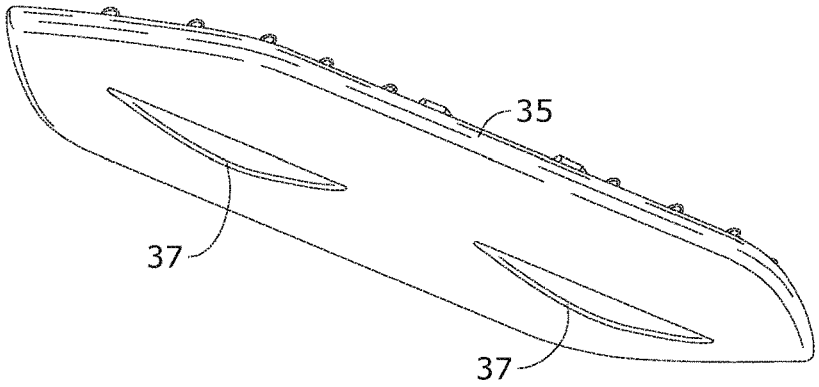
FIG. 15 shows a bottom perspective view of an embodiment of the invention shown with removable keel 37.
Figure 16:
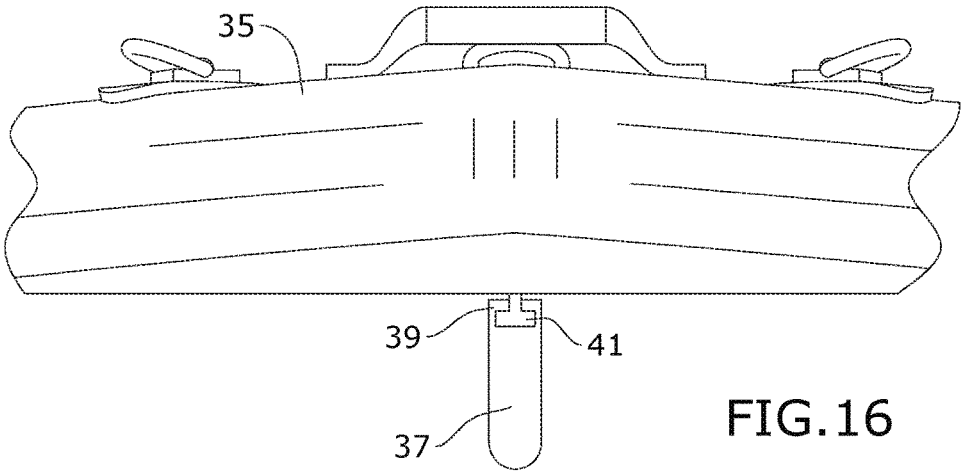
FIG. 16 shows a front view of an embodiment of the invention shown with removable keel and mated connectors.

FIGS. 15 and 16 show another way of attaching the keel. Here, hull bottom 35 is attached to a board clip 41. The board clip 41 mates with the keel clip 39 on keel 37.

Figure 17:
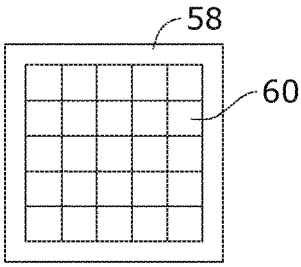
FIG. 17 shows a top view of an embodiment of the insert shown with solar panel 60.
Figure 18:
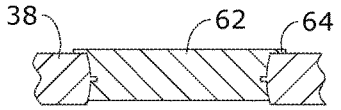
FIG. 18 shows a section view of an embodiment of the insert.
Figure 20:
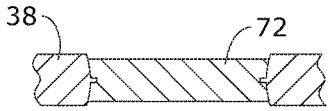
FIG. 20 shows a section view of an embodiment of the insert.
Figure 19:
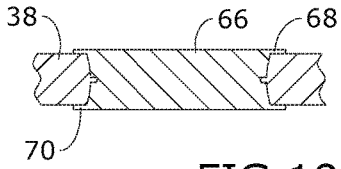
FIG. 19 shows a section view of an embodiment of the insert.
Figure 21:
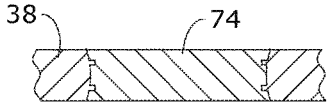
FIG. 21 shows a section view of an embodiment of the insert.
Figure 22:
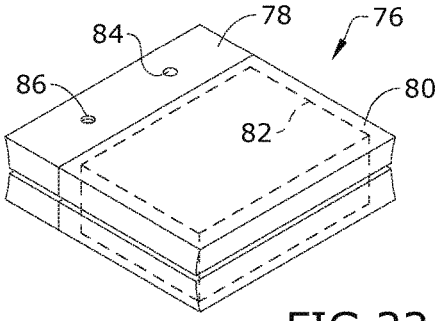
FIG. 22 shows a perspective view of an embodiment of the insert shown with threaded attachment 86 and a through attachment hole 84.
Figure 23:
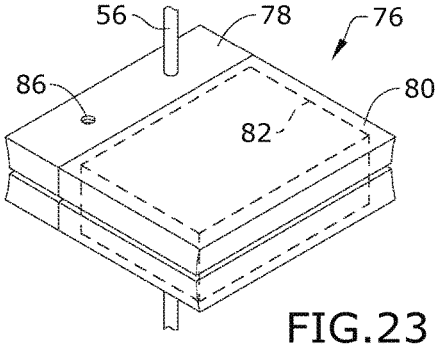
FIG. 23 shows a perspective view of an embodiment of the insert, with pole 56 inserted shown with threaded attachment 86.
Figure 24:
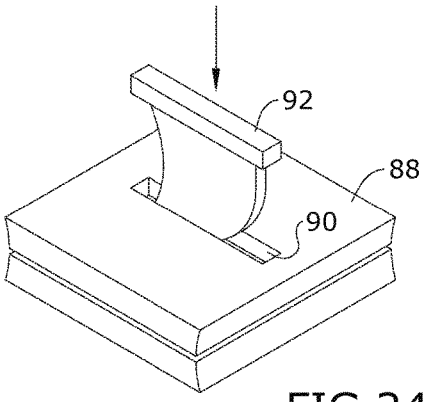
FIG. 24 shows a perspective view of an embodiment of the insert, illustrating the insertion of fin or centerboard 92.
Figure 25:
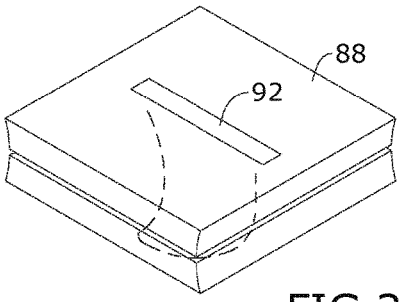
FIG. 25 shows a perspective view of an embodiment of the insert, with fin or centerboard 92 inserted.
Figure 26:
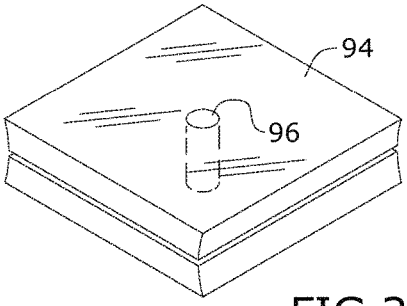
FIG. 26 shows a perspective view of an embodiment of the insert shown with attachment hole 96.
Figure 27:
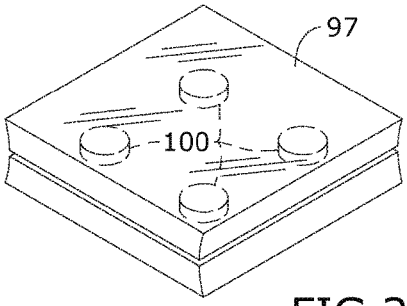
FIG. 27 shows a perspective view of an embodiment of the insert shown with lights 100.

There are many different ways to utilize the insert 50. For instance, in FIG. 17, an insert assembly 58 further comprises a solar panel 60. In FIG. 18, an insert assembly 62 further comprises an upper lip 64. In FIG. 19, an insert assembly 66 further comprises an upper lip 68 and a lower lip 70. In FIG. 20, an insert assembly 72 is recessed from the top side and bottom side of the quad bow board 38. In FIG. 21, the insert assembly 74 further comprises a pair of female attachment points. In FIGS. 22 and 23, the insert assembly 76 further comprises a solid section 78 that further comprises through hole 84 and threaded hole 86. The solid section 78 is adjacent to a compartment section 80 housing a compartment 82. Compartment 82 can be accessed by a top hatch. In FIGS. 24 and 25, the insert assembly 88 further comprises an attachment slot 90 through which a fin insert 92 can be placed. In FIG. 26, the insert assembly 94 further comprises a central through hole 96. In FIG. 27, insert assembly 97 further comprises a plurality of lights built into the insert assembly 97 through holes 100.

Figure 28:
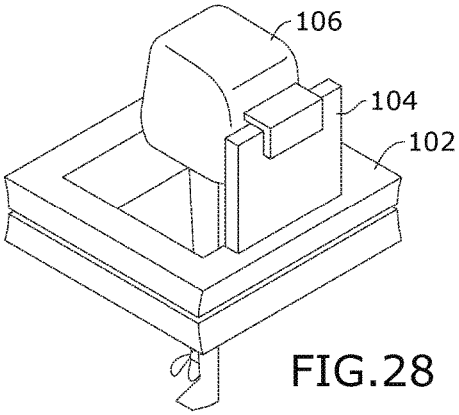
FIG. 28 shows a perspective view of an embodiment of the insert shown with motor 106 attached to motor mount 104.
Figure 29:
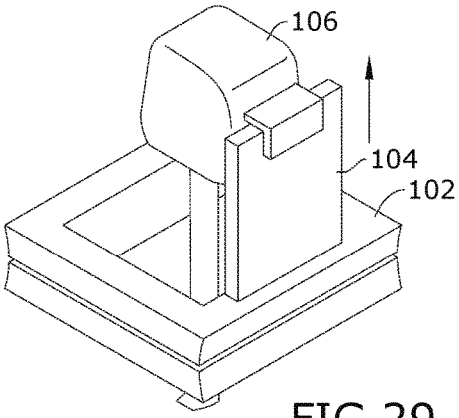
FIG. 29 shows a perspective view of an embodiment of the insert, illustrating the adjustment of bracket 104.
Figure 30:
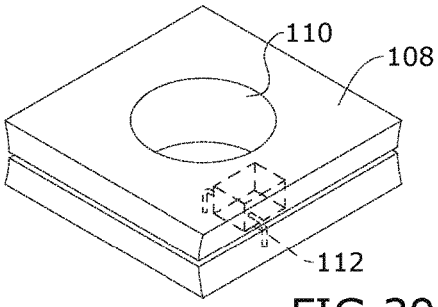
FIG. 30 shows a perspective view of an embodiment of the insert shown with fishing hole 110 and live bait well 108 with water recirculating motor 112.
Figure 31:
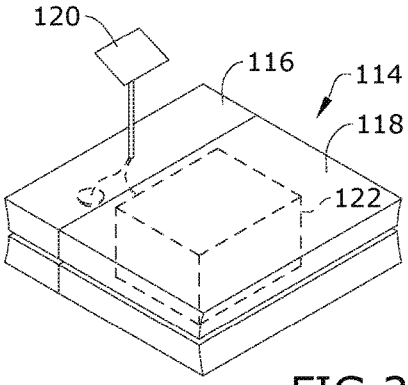
FIG. 31 shows a perspective view of an embodiment of the insert shown with fish finder 120 and battery 122.

In FIGS. 28 and 29, the insert assembly 102 further comprises a motor bracket mount 104 mechanically coupled to a motor 106. The motor bracket mount 104 can be raised and lowered to maneuver the motor 106 as desired. The insert assembly 108 shown in FIG. 30 further comprises fish hole 110 and pump 112 to store fish that are caught with an appropriate amount of water. FIG. 31 shows insert assembly 114 that further comprises a solid section 116 adjacent to a compartment section 118. The solid section 116 is mechanically coupled to a fish finder 120. The fish finder 120 is electrically coupled to a battery 122 stored in the compartment section 118.

Figure 32:
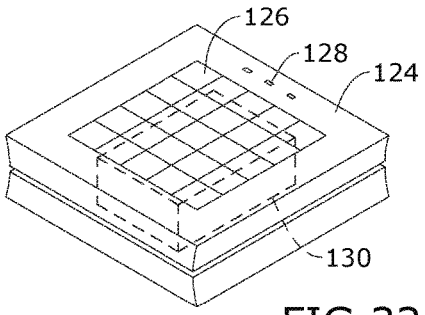
FIG. 32 shows a perspective view of an embodiment of the insert shown with solar panel 126, USB charging ports 128, battery compartment 130.
Figure 33:
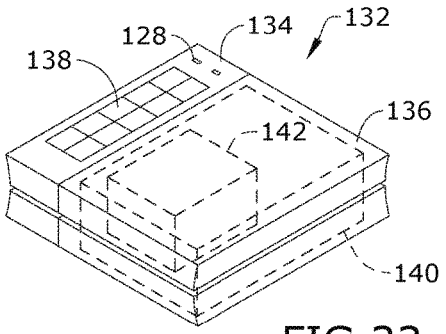
FIG. 33 shows a perspective view of an embodiment of the insert shown with solar panel 126, USB charging ports 128, and battery compartment 130.

In FIG. 32, the insert assembly 124 further comprises a solar panel 126 that is electrically coupled to a battery 130. The battery 130 is electrically coupled to a plurality of universal serial bus ports 128. In FIG. 33, the insert assembly 132 further comprises a solid section 134 adjacent to a compartment section 136 housing a compartment 140. A battery 142 is electrically coupled to a solar cell 138 and the plurality of universal serial bus ports 128.

Figure 34:
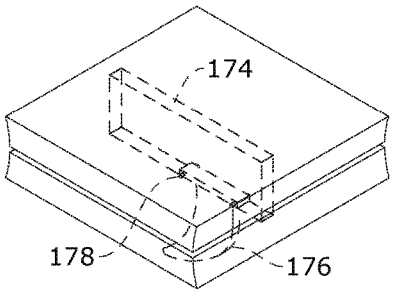
FIG. 34 shows a perspective view of an embodiment of the insert shown with breakaway removable fin 176
Figure 35:
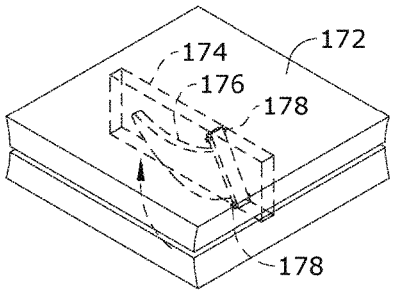
FIG. 35 shows a perspective view of an embodiment of the insert.
Figure 36:
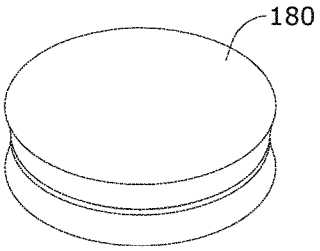
FIG. 36 shows a perspective view of an embodiment of the insert.

In FIGS. 34 and 35, the insert assembly 172 further comprises an insert slot 174. A button mounted fin 176 is connected to the insert slot 174 with a plurality of buttons 178. The insert assembly need not be a parallelepiped. As shown in FIG. 36, insert assembly 180 is round.

Figure 37:
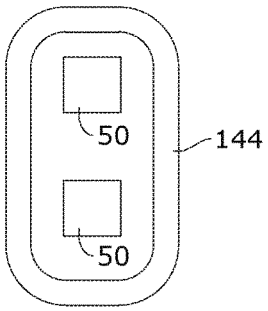
FIG. 37 shows a schematic view of the insert in an alternate arrangement.
Figure 38:
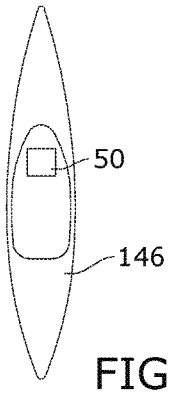
FIG. 38 shows a schematic view of the insert in an alternate arrangement.

FIG. 37 shows a raft 144 further comprising a plurality of insert boxes 50. FIG. 38 shows a kayak 146 further comprising an insert box 50.

Figure 39:
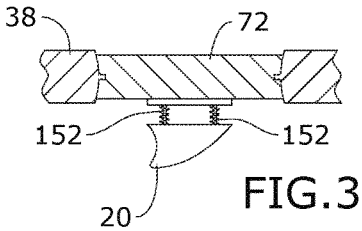
FIG. 39 shows a section view of an embodiment of the insert shown with spring 152 and fin 20 attached.
Figure 40:
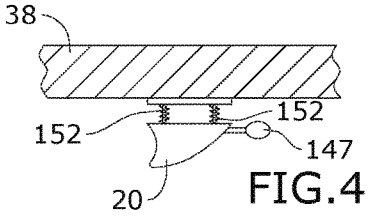
FIG. 40 shows a section view of an embodiment of the insert shown with the spring 152, fin 20, and camera 147.
Figure 41:
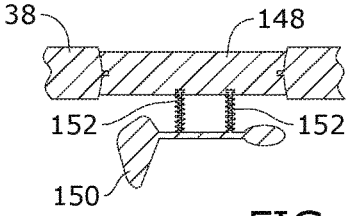
FIG. 41 shows a section view of an embodiment of the insert shown with the spring 152 and fin vane 150 connected to the insert.
Figure 42:
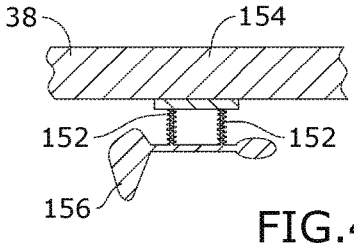
FIG. 42 shows a section view of an embodiment of the insert shown with the spring 152 and fin vane 156 connected to the board 154.
Figure 43:
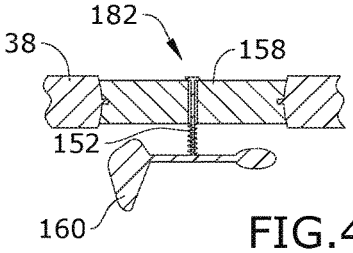
FIG. 43 shows a section view of an embodiment of the insert shown with the spring 152 connected to the fin vane 160 connected to the insert 158.
Figure 44:
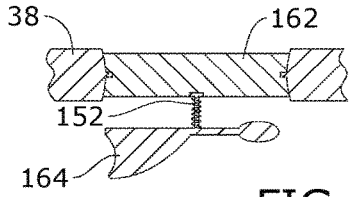
FIG. 44 shows a section view of an embodiment of the insert shown with the spring 152 connected to the fin vane 160 connected to the insert 158.
Figure 45:
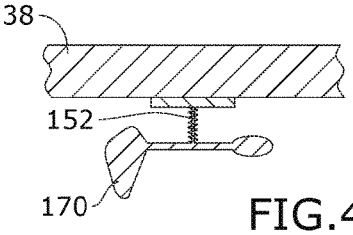
FIG. 45 shows a section view of an embodiment of the insert connected with the spring 152 connected to the fin vane 170 connected to the board 38.
Figure 46:
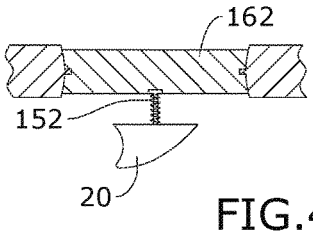
FIG. 46 shows a section view of an embodiment of the insert shown with the spring 152 connected to the fin 20 connected to the insert 162.

FIG. 39 shows the insert assembly 72 mechanically coupled to fin 20. In FIG. 40, the fin 20 is mechanically coupled to camera 147. In FIG. 41, insert assembly 148 is mechanically coupled to fin vane 150 with a plurality of springs 152. FIG. 42 shows a fin vane 156 attached to a block or fin box in insert assembly 154 with a plurality of springs 152. FIGS. 43 and 44 shows a first insert assembly 158 connected to a second insert assembly 162. The first insert assembly 158 is mechanically coupled to a first fin vane 160 with a first spring 152. A second fin assembly 164 is attached to the second insert assembly. FIGS. 45 and 46 are similar.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of an embodiment of the invention is reflected by the breadth of the claims below rather than narrowed by the embodiments described above.

What is claimed is:

1. A quad bow paddle board, configured to accommodate propulsion in at least two directions at once, the quad bow paddle board comprising:

a first bow with a first pointed end at a first distal end;

a second bow with a second pointed end at a second distal end opposite the first distal end;

an insert box arranged midway between the first bow and the second bow;

a first longitudinal axis extending from the first pointed end to the second pointed end and bisecting the insert box;

a third bow with a third pointed end at a third distal end extending from the insert box;

a fourth bow with a fourth pointed end at a fourth distal end extending from the insert box and opposite the third distal end;

a second longitudinal axis extending from the third pointed end to the fourth pointed end; wherein the second longitudinal axis is approximately perpendicular to the first longitudinal axis; and at least one fin attached to an underside of the quad bow paddle board.

2. The quad bow paddle board of claim 1, wherein the insert box is rigid with a female insert; and the bow board is inflatable with a male insert that mates with the female insert to hold the insert box in place.

3. The quad bow paddle board of claim 2, further comprising a plurality of handles and a plurality of lash rings attached to a top side of the dual bow board.

* * * * *